US007280780B2

(12) United States Patent
Bardolatzy et al.

(10) Patent No.: US 7,280,780 B2
(45) Date of Patent: Oct. 9, 2007

(54) CONTROL PANEL FOR AN ELECTROPHOTOGRAPHIC PRINTER OR COPIER SYSTEM WITH FRONT AND/OR REAR PROCESSING UNITS AND INTEGRATED CONTROL PANEL IN A PRINTER SERVER

(75) Inventors: Ulrich Bardolatzy, Poing (DE); Albin Stoderschnig, München (DE); Bernd Sorgenfrei, München (DE); Michael Flexeder, Poing (DE); Andreas Gräf, Gröbenzell (DE); Alexander Kammerlocher, Zorneding (DE); Andreas Schwarzmüller, München (DE); Gerhard Schwaiger, Oberhaching (DE); Thomas Meder, Erding (DE); Andreas Hirn, Pliening (DE)

(73) Assignee: Oce Printing Systems GmbH, Poing (DE)

( * ) Notice: Subject to any disclaimer, the term of this patent is extended or adjusted under 35 U.S.C. 154(b) by 247 days.

(21) Appl. No.: 10/518,179

(22) PCT Filed: Oct. 24, 2003

(86) PCT No.: PCT/EP03/11858

§ 371 (c)(1),
(2), (4) Date: Dec. 15, 2004

(87) PCT Pub. No.: WO2004/038578

PCT Pub. Date: May 6, 2004

(65) Prior Publication Data

US 2005/0226646 A1 Oct. 13, 2005

(30) Foreign Application Priority Data

Oct. 28, 2002 (DE) ..... 102 50 181

(51) Int. Cl.
*G03G 15/00* (2006.01)

(52) U.S. Cl. ..... 399/81; 399/407

(58) Field of Classification Search ..... 399/81, 399/407

See application file for complete search history.

(56) References Cited

U.S. PATENT DOCUMENTS 4,475,806 A * 10/1984 Daughton et al. ..... 399/81
5,200,778 A 4/1993 Ito (Continued)

FOREIGN PATENT DOCUMENTS

DE 196 11 645 10/1996

(Continued)

*Primary Examiner*—Susan Lee
(74) *Attorney, Agent, or Firm*—Schiff Hardin LLP

(57) ABSTRACT

A printer or copier system with at least one of a pre-processing unit and a post-processing unit, comprises a printing unit that generates a print image on a carrier material. An operating unit is connected via a data line with the printing unit. The operating unit outputs at least one graphical user interface on a display for operation of the printing unit. At least one processing unit is connected with at least one of the printing unit and the operating unit for processing of the carrier material such that data are transferable between the processing unit and at least one of the printing unit and the operating unit. In the processing unit, data are stored that are transferred to at least one of the printing unit and the operating unit with which the graphical user interface is activated at least for operation of the processing unit.

22 Claims, 10 Drawing Sheets

U.S. PATENT DOCUMENTS

| | | | | |
|---|---|---|---|---|
| 5,579,087 | A | 11/1996 | Salgado | |
| 5,583,617 | A * | 12/1996 | Altrieth et al. | 399/81 |
| 5,585,891 | A | 12/1996 | Altrieth et al. | |
| 5,805,950 | A | 9/1998 | Inglese et al. | |
| 6,850,337 | B1 * | 2/2005 | Anderson et al. | |
| 6,930,791 | B2 * | 8/2005 | Jackelen | |
| 6,952,780 | B2 * | 10/2005 | Olsen et al. | |
| 7,099,034 | B2 * | 8/2006 | Anderson et al. | |
| 2001/0030755 | A1 * | 10/2001 | Yamade | |
| 2001/0055492 | A1 | 12/2001 | Wood et al. | |
| 2003/0004832 | A1 * | 1/2003 | Kamimoto et al. | |
| 2003/0035672 | A1 * | 2/2003 | Kidani et al. | |
| 2004/0239981 | A1 * | 12/2004 | Ducato et al. | |

FOREIGN PATENT DOCUMENTS

| | | |
|---|---|---|
| DE | 197 35 957 | 2/1999 |
| DE | 198 36 745 | 2/2000 |
| EP | 0 678 792 | 10/1995 |

* cited by examiner

CONTROL PANEL FOR AN ELECTROPHOTOGRAPHIC PRINTER OR COPIER SYSTEM WITH FRONT AND/OR REAR PROCESSING UNITS AND INTEGRATED CONTROL PANEL IN A PRINTER SERVER

BACKGROUND

The disclosure concerns a printer or copier system with a pre-processing unit and/or a post-processing unit in which a common control panel is provided for a printing unit and a processing unit. The disclosure also concerns a method for the operation of a printer or copier system with a pre-processing unit and/or a post-processing unit as well as an operating unit for the operation of a printer or copier system with a pre-processing unit and/or a post-processing unit.

In known printer or copier systems, individual components (such as printers, pre- and post-processing units) in what are known as printer or copier paths respectively have a separate control panel whose user interface has been created for the respective component. Furthermore, electrophotographic printer or copier systems are known in which a common control panel is provided for a feeder unit and a print unit. The control panel has been operated with the aid of a special software that provides a common user interface for the feeder unit and the print unit. However, an exchange of the feeder unit with a feeder unit of another type is only possible when the software of the operating unit has been exchanged. An integration of further components of the print path is not possible in known electrophotographic printer or copier systems. Thus various components of the print path have different user interfaces with different operating philosophies. A simple and central operation of the print path is presently not possible in electrophotographic printer or copier systems.

A printer or copier in which the operation of accessory devices for pre- and/or post-processing can be mutually operated via a common operating unit of the printer or copier is known from the document DE 196 11 645 A1. Based on the sensor signals, a controller of the printer or copier generates corresponding signals for the control of various working devices within the printer or copier.

A printing system with two printers working in tandem operation is known from the document DE 198 36 745 A1, whereby at least the control panel computer of the first printer and second printer are connected with one another via a data line. The document is a disclosure document of a patent application by OcéPrinting System GmbH. A control unit of the first printer and a control unit of the second printer are also connected with one another via a data line. Changed setting values are automatically directly transmitted to the other control unit, such that other parameters can be adapted in the second control unit with the aid of the transmitted adjustment value.

From the document US 2001/0055492, a printer or copier is known in which a user interface for a supervisor is also provided over a network with the aid of a web server. In particular settings of the printer or copier can thereby also be set simply from a remote location.

SUMMARY

It is an object to specify a printer or copier system with a pre-processing unit and/or a post-processing unit, in which both the operation of the printer or copier system and the pre- and/or post-processing systems is possible in a simple manner with a common operating unit. It is also an object to specify a method for the operation of a printer or copier system with a pre-processing unit and/or a post-processing unit as well as an operating unit via which the operation of printer or copier systems with pre- and/or post-processing units is possible in a simple manner.

A printer or copier system with at least one of a pre-processing unit and a post-processing unit comprises a printing unit that generates a print image on a carrier material. An operating unit is connected via a data line with the printing unit. The operating unit outputs at least one graphical user interface on a display for operation of the printing unit. At least one processing unit is connected with at least one of the printing unit and the operating unit for processing of the carrier material such that data are transferable between the processing unit and at least one of the printing unit and the operating unit. In the processing unit, data are stored that are transferred to at least one of the printing unit and the operating unit with which the graphical user interface is activated at least for operation of the processing unit.

DESCRIPTION OF THE PREFERRED EMBODIMENT

Figure 1:
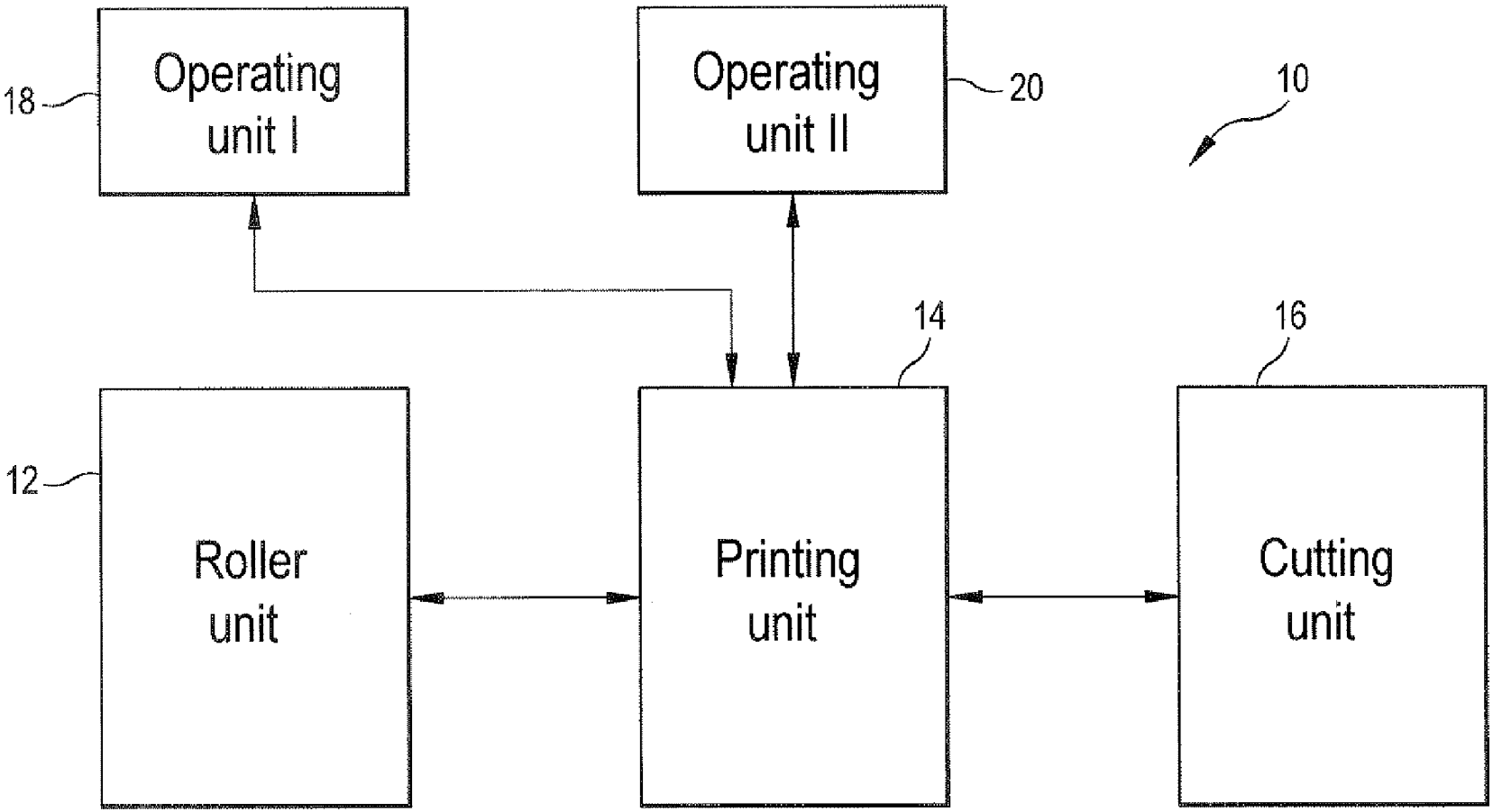
FIG. 1 is a block diagram of a printing system with two operating units.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Primarily in that data that are transmitted to the printing unit and/or to the operating unit are stored in the processing unit, a graphical user interface can at least be activated for the operation of the processing unit. A user interface, via which the operation of a processing unit is also possible with the aid of the operating unit for the operation of the printing unit, can thereby be provided or activated in a simple manner. Both the printing unit and the processing unit are thus also operated via a common operating unit without the installation of a software specially adapted to the printing unit and the processing unit. After the connection of the processing unit with the printing unit or with the operating unit, the data can, for example, be immediately transmitted to the operating unit that then automatically supplements the user interface with components for the operation of the processing unit.

With the aid of the common operating unit, it is further achieved that a uniform operating philosophy as well as a centrally overseen operation of entire printer or copier paths is possible. The printer or copier system is preferably an electrophotographic printer or copier system.

A second aspect concerns a method for the operation of a printer or copier system with a pre-processing unit and/or post-processing unit. Via this method, the processing unit can be simply operated via the operating unit of the printing unit or an autonomous operating unit via simple connection of the printing unit with a pre-processing unit and/or post-processing unit. The operating unit is then what is known as a Single Point of Operation, since both the printing unit and the pre-processing unit and/or post-processing unit can be operated via the operating unit. A uniform operating philosophy can thereby also be changed simply. An electrophotographic printer or copier system is preferably simply operated with the aid of the method according to the second aspect.

A third aspect concerns a printer or copier system with a pre-processing unit and/or post-processing unit, in which system a data processing unit is provided that controls and monitors the execution of print jobs of at least one printing unit and furthermore provides at least one graphical user interface for the operation of the printing unit and/or the processing unit. It is thereby simply possibly to operate the printer or copier system as well as the pre-processing unit and/or post-processing unit with the aid of the same data processing unit with which the execution of the print jobs is also controlled and monitored. For example, an operating personnel can thereby both generate and coordinate the print jobs and operate the printer or copier system with pre-processing unit and/or post-processing unit from a central location. Separate operating units at the printer or copier system as well as at the pre- and/or post-processing units are no longer absolutely necessary. The operation of the printer or copier system thereby occurs centrally in a simple manner. Given such an inventive printer or copier system, a further printer or copier system can also be operated via the data processing unit via the graphical user interface. The printer or copier system according to the third aspect is preferably an electrophotographic printer or copier system.

A fourth aspect concerns a further method for the operation of a printer or copier system with a pre-processing unit and/or post-processing unit. In this method, the execution of a print job is controlled and monitored by a data processing unit, whereby furthermore a graphical user interface is provided by the data processing unit for the operation of the printing unit and/or of the processing unit. With the aid of such a method, it is simply possible to implement the print preparation and print job control and simultaneously the operation of the printing unit and/or the processing unit from a data processing unit. A simple and clear operation of the printing unit and/or the processing unit is thereby possible. Separate control panels for the printing unit and/or the processing unit are not necessary. The method according to the fourth aspect is preferably used for the operation of an electrophotographic printer or copier system.

A fifth aspect concerns an operating unit for at least one printer or copier. The operating unit has a display unit that outputs a graphical user interface. The graphical user interface has a first section with a user interface on which input and/or output fields can be displayed with information about parameters of the printer and/or a processing unit connected with the printer. The user interface has a second section in which a menu is contained via which a user interface that is shown in the first section can be selected from a plurality of displayable user interfaces. The user interface has at least a third section in which at least one graphical function key is contained for the operation of the printer and/or the processing unit connected with the printer. A very simple and clear operation of the printer and of processing devices connected with the printer is possible via such an inventive operating unit. A uniform operating philosophy can also be realized simply with such an operating unit. Faulty operations of individual processing units are at least reduced via the uniform user interface. A change between a plurality of user interfaces is simply possible via the menu, whereby graphical function keys for important operating functions are provided in the third section. A simple operation of components of complex printing paths is thereby simply possibly. Orientation times are thereby reduced. The operating unit preferably serves to operate an electrophotographic printer or copier.

A sixth aspect concerns a method for the operation of a printer or copier. Via the division of the graphical user interface into three sections, a simple and clear operation of the printer or copier and of whole printer or copier paths is possible. The method according to the sixth aspect is preferably used for the operation of an electrophotographic printer or copier.

For the better understanding of the preferred embodiment, reference is made in the following to preferred exemplary embodiments shown in the drawings that are described using specific terminology. However, it is noted that the protective scope of the invention should not thereby be limited, since such variations and further modifications to the shown devices and/or the methods as well as such further applications of the invention as they are indicated therein are viewed as typical present or future specialized knowledge of a competent average man skilled in the art.

A block diagram of a printing system 10 is shown in FIG. 1. The printing system 10 comprises a roller unit 12 for a band-shaped carrier material (such as, for example, a paper roll), a printing unit 14 to print the continuous carrier material and a cutting unit 16 to cut the carrier material after the printing. The printing system 10 furthermore comprises a first operating unit 18 and a second operating unit 20. The first operating unit 18 and the second operating unit 20 are connected with the printing unit 14 via a local network, for example via a LAN (local area network). The roller unit 12 and the cutting unit 16 are respectively connected with the printing unit 14 via at least one data line.

After the connection of the roller unit 12 with the printing unit 14, data are transferred (over the data line) via which, in the printing unit 14, data are read out from a storage region to generate a common graphical user interface for the roller unit 12 and the printing unit 14. The cutting unit 16 likewise transfers data to the printing unit 14 via which the printing unit 14 reads out data from a storage region for the generation of a user interface for the roller unit 12, the printing unit 14 and the cutting unit 16. This common graphical user interface is then displayed both on the operating unit 18 and on the operating unit 20.

The data transferred from the roller unit 12 to the printing unit 14 comprises at least information to identify the type of the roller unit 12. With the aid of the type of the roller unit 12, the printing unit 14 determines the data from a data storage in which at least the data to generate a user interface of the roller unit 12 and the cutting unit 16 are stored, said data being necessary to generate the user interface as well as to generate a special user interface for the operation of the roller unit 12. The special user interface is integrated into the user interface. In the same manner, the data transferred from the cutting unit 16 to the printing unit 14 comprises at least specifications about the type of the cutting unit 16, whereby with the aid of this data a control panel for the operation of the cutting unit is generated with the aid of data stored in the printing unit 14. A data processing unit of the printing unit 14 thereby generates a user interface with which both the printing unit 14 and the roller unit 12 and the cutting unit 16 are operable. A registration of the cutting unit 16 and the roller unit 12 in the printing unit 14 thus occurs with the aid of the data transferred from the roller unit 12 and the cutting unit 16. A central control unit (not shown) arranged in the printing unit 14 for the control of the print process of the entire printing system 10 furthermore receives information for the control of the roller unit 12 and the cutting unit 16 via the data transferred from the roller unit 12 and the cutting unit 16. This control unit can, for example, also be comprised in the data processing unit of the printing unit 14.

Alternatively, data that contain all information about the roller unit 12 necessary for the generation of a common user interface of the printing unit 14 and the roller unit 12 are transferred from the roller unit 12 to the printing unit 14. Furthermore, these data also comprise detailed information (that is needed by the central control unit arranged in the printing unit 14 for the control of the roller unit 12) for the generation of a control panel for the roller unit 12 and to control the roller unit 12. In the same manner as from the roller unit 12, data that comprise all information necessary for the generation of a common user interface of the printing unit 14 and the cutting unit 16 are transferred from the cutting unit 16 to the printing unit 14. Furthermore, data are transferred from the cutting unit 16 to the printing unit 14, via which data a control of the cutting unit 16 via a central control unit of the printing unit 14 and the generation of a control panel for the cutting unit are enabled. The generated user interface is output on the operating unit 18 and/or on the operating unit 20. The control panels primarily contain input and output fields for the display and output of parameters and measurement values as well as counted values of the printing unit 14, the roller unit 12 and the cutting unit 16.

The registration of the roller unit 12 and the cutting unit 16 with the printing unit 14 as well as the transfer of the data from the roller unit 12 and the cutting unit 16 to the printing unit 14 preferably occurs automatically after the connection of the roller unit 12 with the printing unit 14 over a first data line and the cutting unit 16 with the printing unit 14 over a second data line. The roller unit 12, the printing unit 14 and the cutting unit 16 are preferably connected with one another via a common network to which in particular the operating units 18, 20 are also connected.

Figure 2:
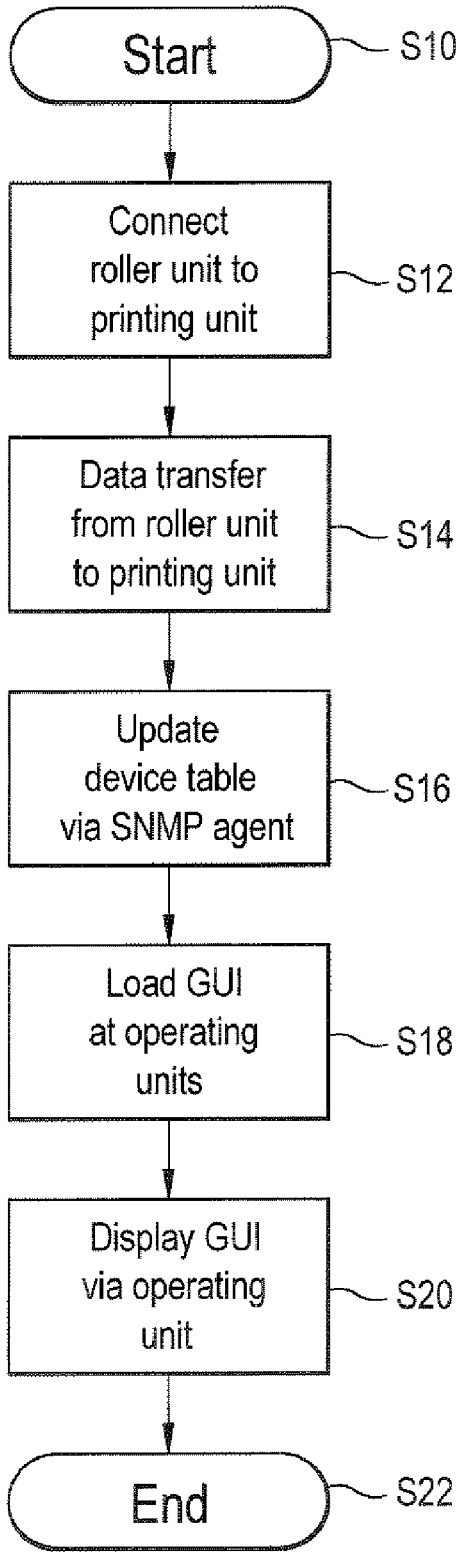
FIG. 2 is a flow plan for the integration of a user interface of a roller unit in user interfaces of the operating units of the printing system according to FIG. 1.

A flow chart is shown in FIG. 2 for the integration of the roller unit 12 into a graphical user interface that is generated by a data processing unit and is output by the operating units 18, 20. Identical elements have the same reference characters. The user interface serves for the operation of the printing unit 14 and of the roller unit 12. The process is started in the step S10. In step S12 the roller unit 12 and the printing unit 14 are subsequently connected with one another via the data line. After the connection of the roller unit 12 and the printing unit 14 in step S12, in step S14 data are transferred at least from the roller unit 12 to the printing unit 14. Information about the roller unit 12 are subsequently inserted into the device table of the printing unit 14 with the aid of the transferred data. The device table of the printing unit 14 comprises information about the devices, components and assembly groups of the printing system 10. The device table is administered with the aid of what is known as an SNMP agent (SNMP=Simple Network Management Protocol). After the updating of the device table in step S16, a common graphical user interface of the roller unit 12 and the printing unit 14 is generated that is transferred to the operating units 18 and 20. The graphical user interface is also designated as a GUI (graphical user interface). After the transfer of the data to the operating units 18, 20, in step S20 with the aid of the transferred data an updated user interface is displayed on display units of the operating units 18, 20 with the aid of display programs, what are known as browser program modules. The process is ended in step S22.

Figure 3:
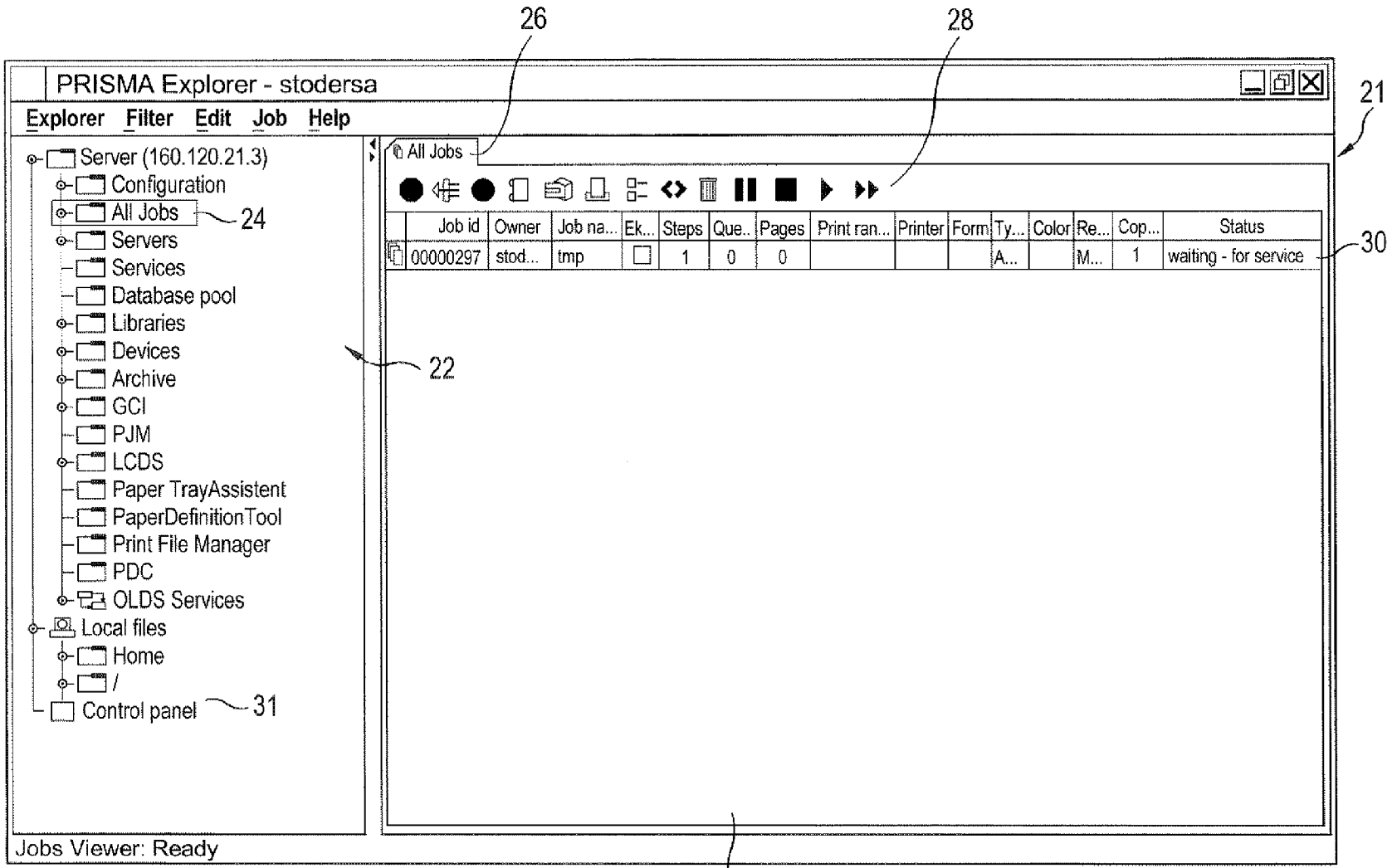
FIG. 3 is a graphical user interface of a print server.

A graphical user interface of a print server is shown in FIG. 3. This print server is responsible for the processing and coordination of print jobs that should be executed by the printing system 10. The graphical user interface 21 comprises a tree-like menu 22 in which a menu 24 with the designation "All Jobs", subordinate to the print server with the network address 160.120.21.3, has been selected by an operating personnel. Via this selection, the print job 30 still not executed is displayed in the window 25. Furthermore, a bar 28 with graphical function keys via which the execution of the print job 30 can be controlled is displayed in the window 25. Both the bar 28 and the print job 30 are contained on a tab 26 with the designation "All Jobs". A control panel of the printing system 10 can be called by invoking a menu entry 31, "control panel".

Figure 4:
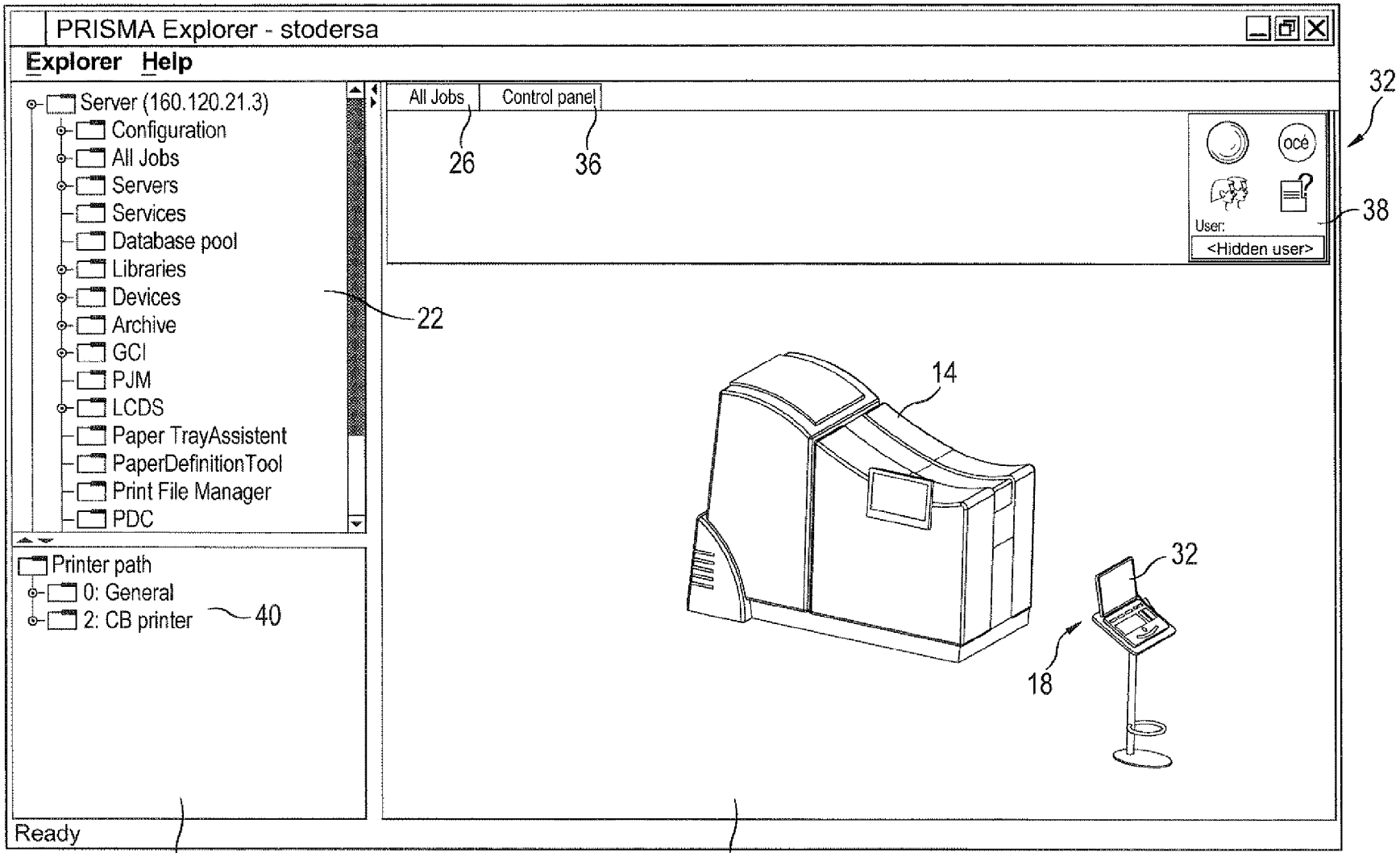
FIG. 4 shows the graphical user interface of the print server according to FIG. 3, whereby a control panel of a printing system is integrated into this user interface.

A graphical user interface 32 of the print server 160.120.21.3 is shown in FIG. 4, whereby, in contrast to the user interface 21 according to FIG. 3, in the user interface 32 the control panel function for the operation of the printing unit 14 is activated. The user interface 32 is generated in that the menu entry 31 in the menu 22 is activated. A control panel menu 34 is thereupon generated, in that the physical units and assembly groups operable with the aid of the operating unit are listed. Furthermore, in the window 25 is a graphical representation of the components of the printing system 10 operable with the aid of the user interface 32.

In particular, depictions with input and output fields for the control of the printing unit 14 can be selected and displayed in the window 25 via selection of the printer 14 in the window 25 or via selection of sub-menus in the control panel menu 34. Furthermore, the window 25 contains a field 38 with function keys for fast access to functions and/or control panel views as well as display fields associated with the function keys. The control panel views in the window 25 and the region 38 with function keys are associated with the tab 36. Via selection of the tab 36 or the tab 26 the print server view and the control panel can simply be switched between. The control panel shown in the window 25 contains a graphical representation of the printing unit 14 and operating unit 18 on which the graphical user interface 32 can be displayed.

Figure 5:
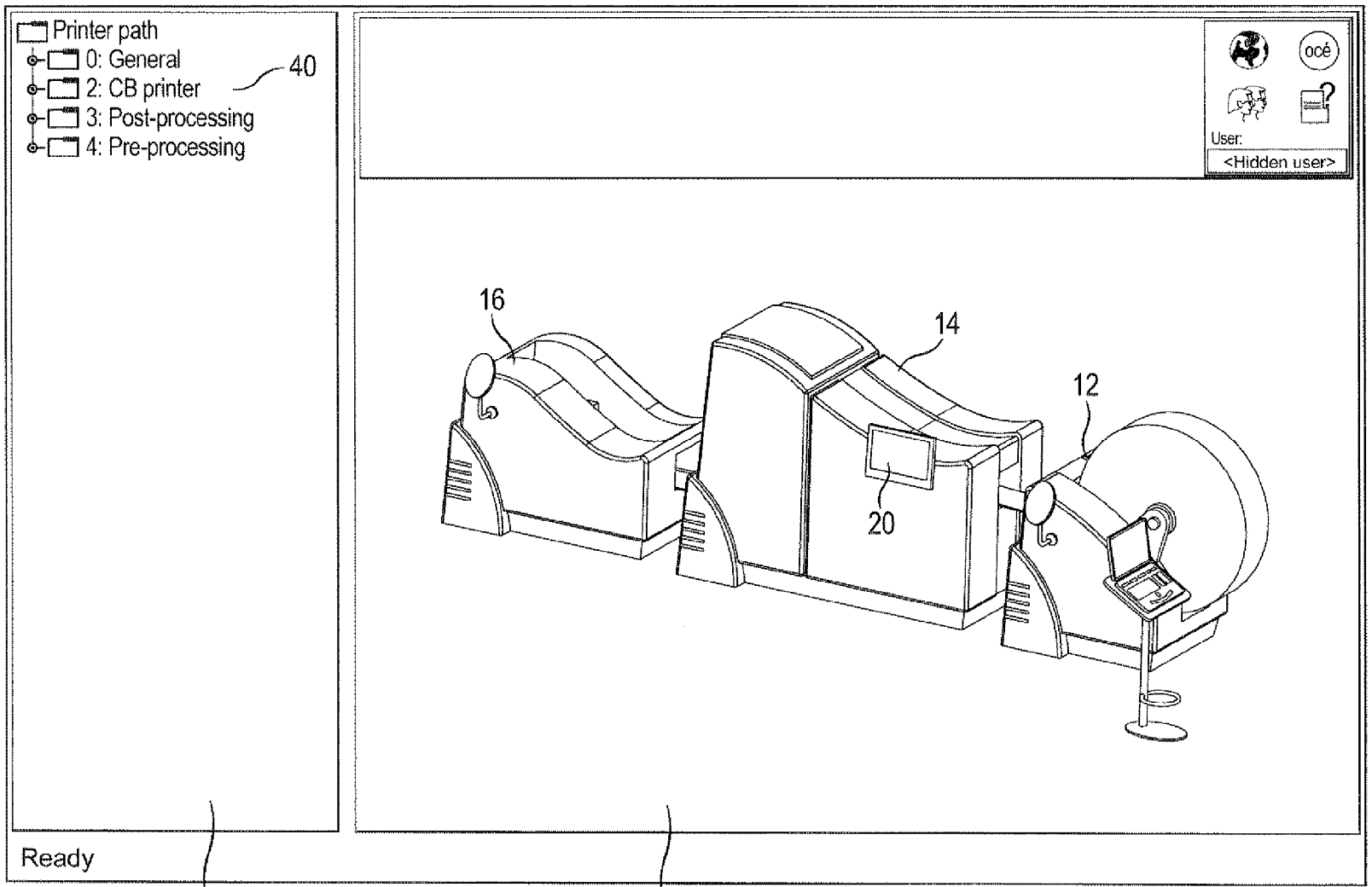
FIG. 5 is a section of the graphical user interface according to FIG. 4 with a control panel for a printing unit, a pre-processing unit and a post-processing unit.

A section of the graphical user interface 32 according to FIG. 4 is shown in FIG. 5 after the roller unit 12 and the cutting unit 16 have been connected with the printing unit 14. As already specified in connection with FIGS. 1 and 2, data are respectively transferred to the printing unit 14 from the roller unit 12 and the cutting unit 15. The menu 34 was supplemented with the menu items 3: post-processing, 4: pre-processing with the aid of this data. In this exemplary embodiment, the post-processing concerns the cutting device 16 and the pre-processing concerns the roller unit 12. Furthermore, respectively a graphical representation of the roller unit 12 and a graphical representation of the cutting unit 16 have been added to the graphical representation of the printing unit 14 in the window 25.

Figure 6:
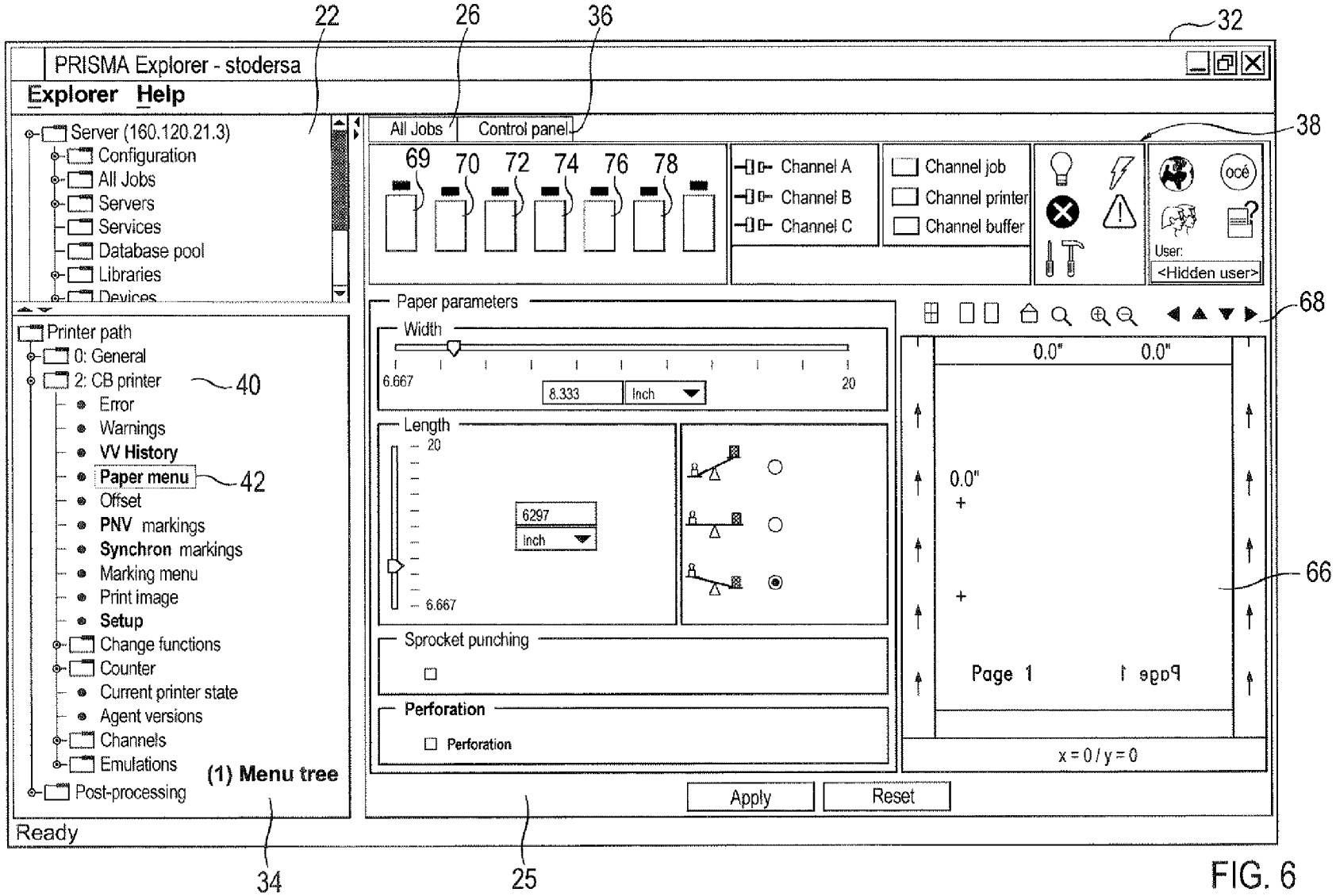
FIG. 6 is a graphical user interface according to a second exemplary embodiment, whereby shown are a user interface to set paper parameters of the printing unit and a plurality of function keys for the operation of the printing unit.

A representation of the user interface 32 according to a second exemplary embodiment is shown in FIG. 6, whereby the printer menu 40 of the printing unit 14 is selected and activated in the control panel menu 34, in that a hierarchically subordinate paper menu 42 has been selected. After this selection of the paper menu 42, paper parameters of the paper web supplied to the printing unit 14 are displayed in the window 25. The paper parameters can be simply set by an operating personnel with the aid of the combined input and output fields 44 through 64. Furthermore, the user interface 32 contains a region 66 in which a shifting of the position of a print image generated on a front side of the paper web is implemented with regard to a print image generated on the back side. The shifting can be implemented with the aid of the function keys arranged in the bar 68. Further function keys for the simple control of the printer have been added in the display field 38 via the selection of the printer menu 40. Thus, for example, the graphical function keys 69 through 80 in the region 38 and the display elements arranged over these keys are based, with regard to their depiction and function, on input keys and display elements present as hardware on the printing unit 14, whereby via the function keys 69 through 80 an operating personnel can operate the printing unit 14 in the same manner as via the hardware input keys arranged on the printing unit 14. The operation of the printing unit 14 is thereby made easier for the operating personnel.

Figure 7:
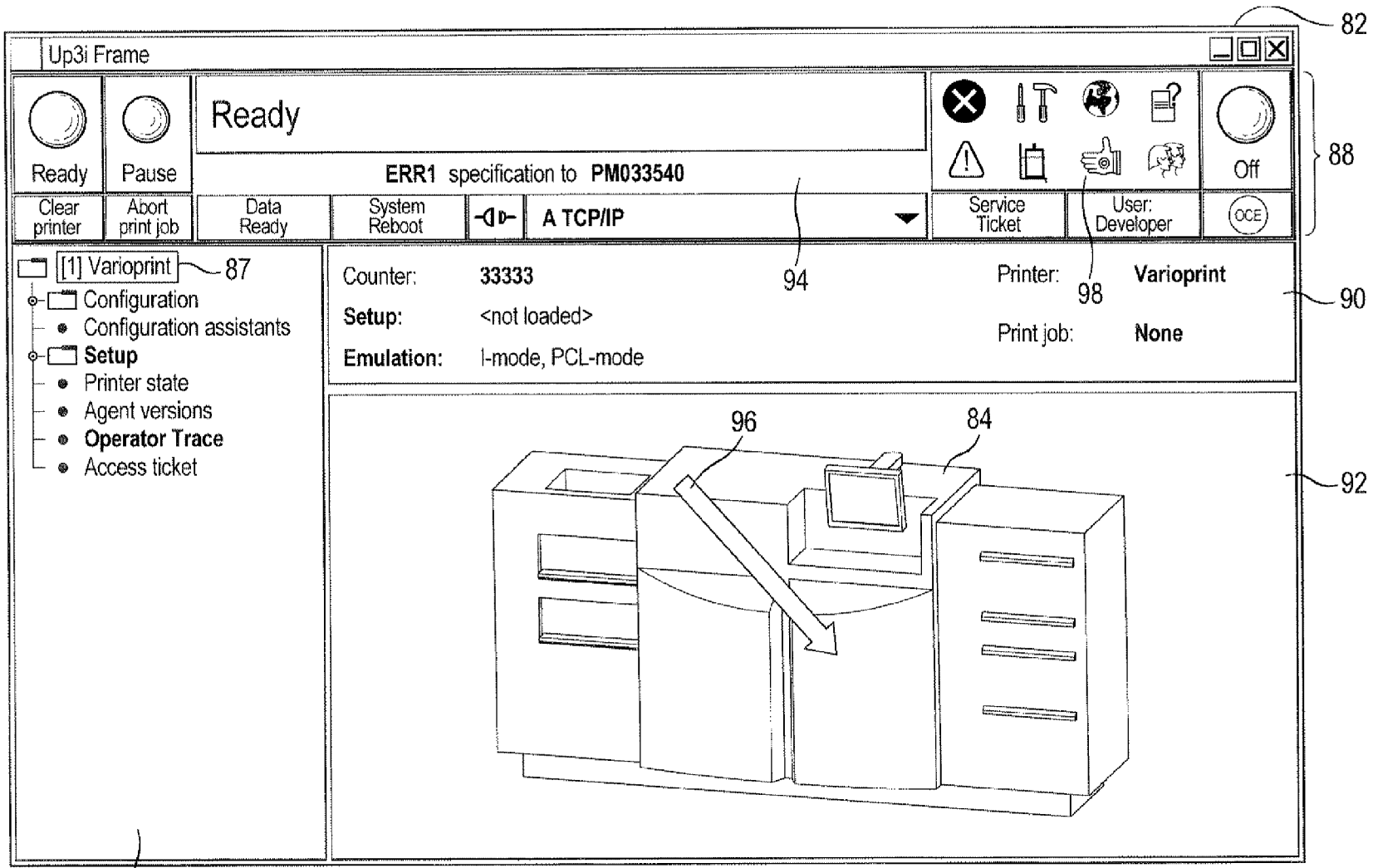
FIG. 7 is a graphical user interface according to a third exemplary embodiment of a graphical user interface in a first display mode.

Shown in FIG. 7 is a first representation of a graphical user interface for the operation of a printing system 84 according to a third exemplary embodiment. The representation of the graphical user interface 82 according to FIG. 7 comprises a menu 86, a region 88 with graphical function keys (what are known as buttons), a region 90 in which current printer parameters are displayed from which one parameter can be selected regarding which further subordinate parameters can then be displayed in the window 92. An error message regarding a current occurred error is output in an output field 94. An indication as to how an operating personnel obtains access to the error location occurs with the aid of an arrow 96. In both the menu region 86 and in the input and output region 90, the information and menus are arranged such that they contain a multitude of entries and information and can be operated simply with the aid of a computer mouse. The first representation of the graphical user interface 82 according to FIG. 7 is adapted for a mouse operation. Via activation of the function key 98, the operating type of the user interface 82 can be changed to a touch-sensitive screen with what is known as finger operation. Such a touch-sensitive screen comprises sensors on the surface or in the border above the display plane that detect the contact by a pen or a finger. With the aid of these sensors, inputs for function control of a program are provided in a manner similar to the operation via a computer mouse. However, for the operation via finger inputs with the aid of a touch-sensitive screen, the distances between activatable input surfaces must be selected correspondingly large in order to not simultaneously activate adjacent input fields given a contact of the touch-sensitive screen with a finger. In contrast to the representation of the user interface for mouse input, the input regions in the representation for touch input with the aid of a finger must thus be arranged removed correspondingly far from one another.

Figure 8:
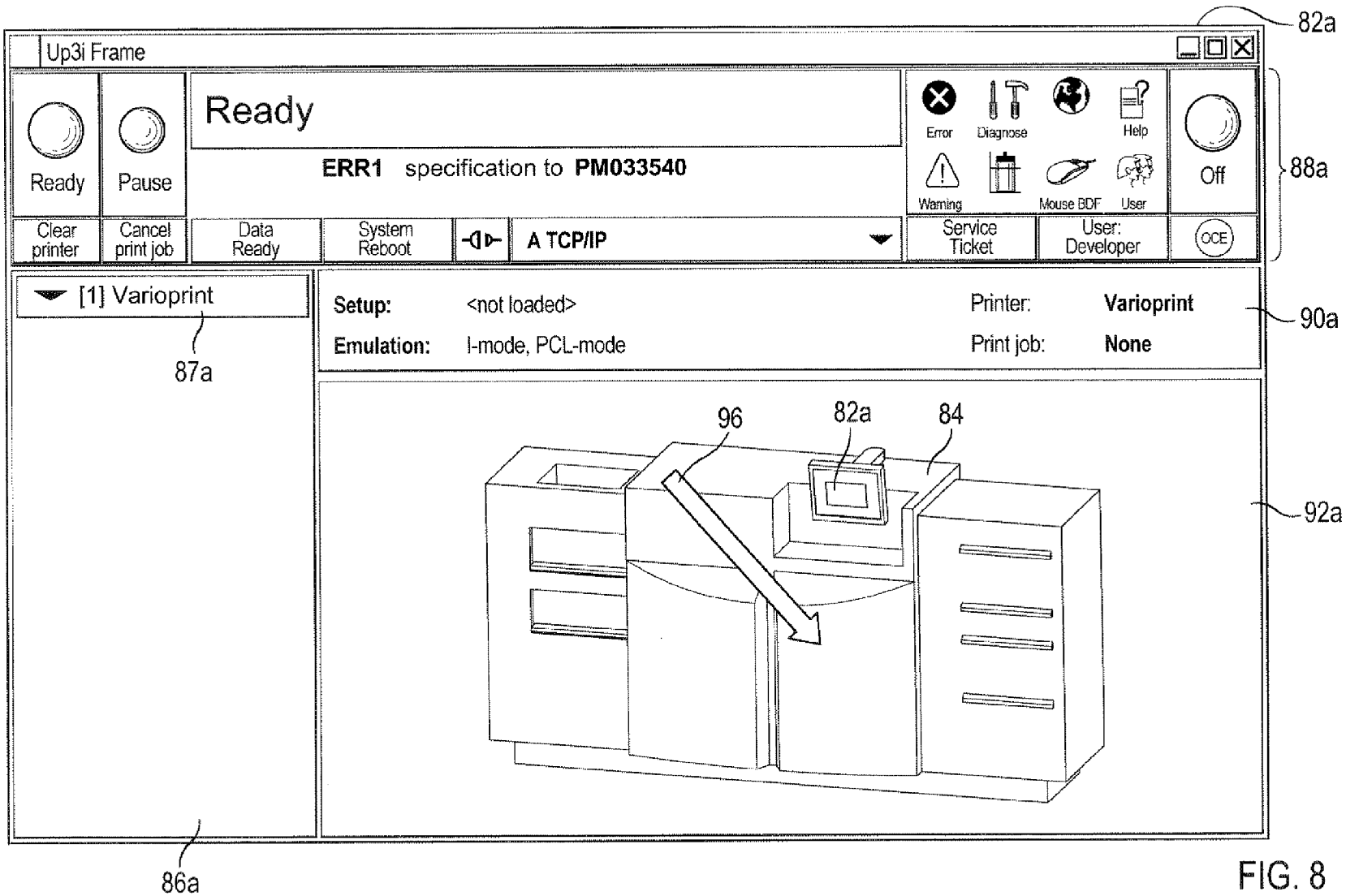
FIG. 8 shows the graphical user interface according to FIG. 7 in a second display mode.

The graphical user interface 82 is shown in FIG. 8 in a second representation for the input with the aid of a finger via a touch-sensitive screen. In the first representation of the graphical user interface 82 in FIG. 7, as already described a switch-over to the representation for touch-sensitive input as it is shown in FIG. 8 is possible with the aid of the function key 98. The individual symbols and buttons in the input field 88*a* of the user interface 82*a* are shown enlarged. The output field 94*a* for the output of the error message is also shown enlarged in the representation of the user interface 82*a* relative to the user interface 82. The menu entry 87*a* in the menu 86*a* is shown enlarged relative to the menu entry 87, whereby the hierarchically subordinate menu entries are only displayed after a selection of the menu entry 87*a* in the menu 86*a*. The number of the input and output fields in the region 90*a* is reduced in the user interface 82*a* relative to the user interface 82. The output field 92*a* with the representation of the printer 84 substantially coincides with the output field 92 of the user interface 82.

Figure 9:
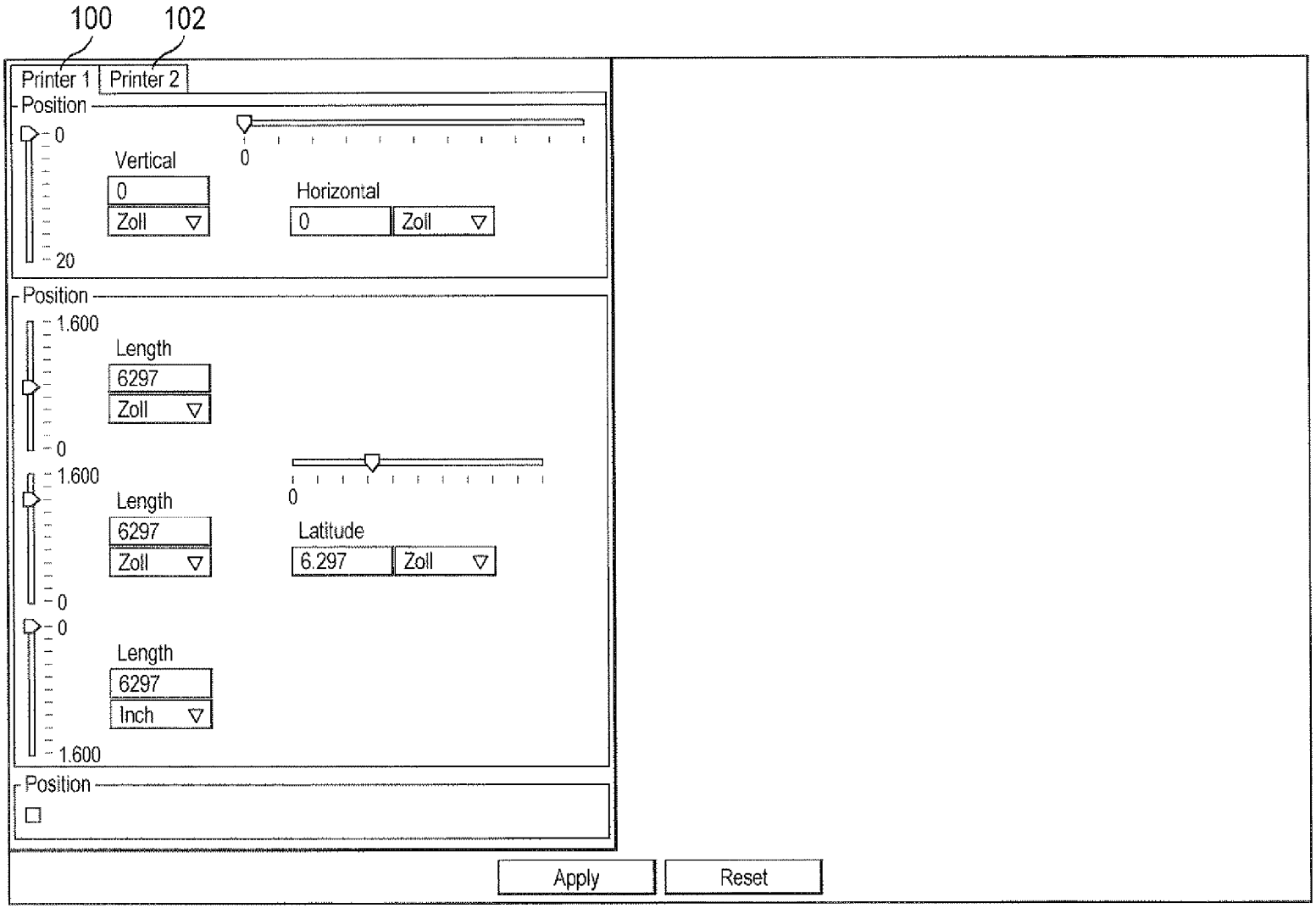
FIG. 9 is a user interface for the operation of two printing units.

In FIG. 9, a control panel is shown for two printers that have been combined into what is known as a twin unit. Such a twin unit comprises at least two significantly identically designed printers, whereby the first printer prints the front side of a carrier material with a print image and the second printer subsequently prints the back side of the carrier material with a print image. The printers of a twin unit are separate components that are arranged at least at a distance from one another, whereby an inverting device can be provided between the two printing units. With the aid of such a twin unit, continuous carrier material is preferably printed that is subsequently further processed, for example with the aid of a cutting unit. With the aid of such an operating unit, parameters that are the same for both printers can be simultaneously changed for both printers. For this, a parameter is changed only in an input field for one printer, whereby this parameter is then also changed identically for the second printer. Tabs 100 and 102 are provided for other parameters such as, for example, toner parameters given different toner colors of the first and second printer, fixing temperatures, print image scales and further different parameters, whereby the tab 100 comprises parameters of the printer 1 and the tab 102 comprises parameters of the printer 2. With the aid of these tabs, a simple switchover of the user interface for the adjustment of the parameters of the first printer and the parameters of the second printer is possible.

However, with the aid of such a twin unit the carrier material can also be printed two-color on one side, whereby a print image is printed in a first color by the printer 1 and a print image is printed in a second color by the printer 2, one atop the other on the same side of the carrier material. At least one printer of the twin unit can also generate a print image with a special toner, for example a magneto toner.

Given reciprocally influencing parameters of the first and the second printer, given a change of one parameter the influenced parameter can be automatically changed in a suitable manner. If, for example, the fixing temperature of the first printer is increased, the image scale of the second printing unit is reduced in order to attain print images of precise registration.

Figure 10:
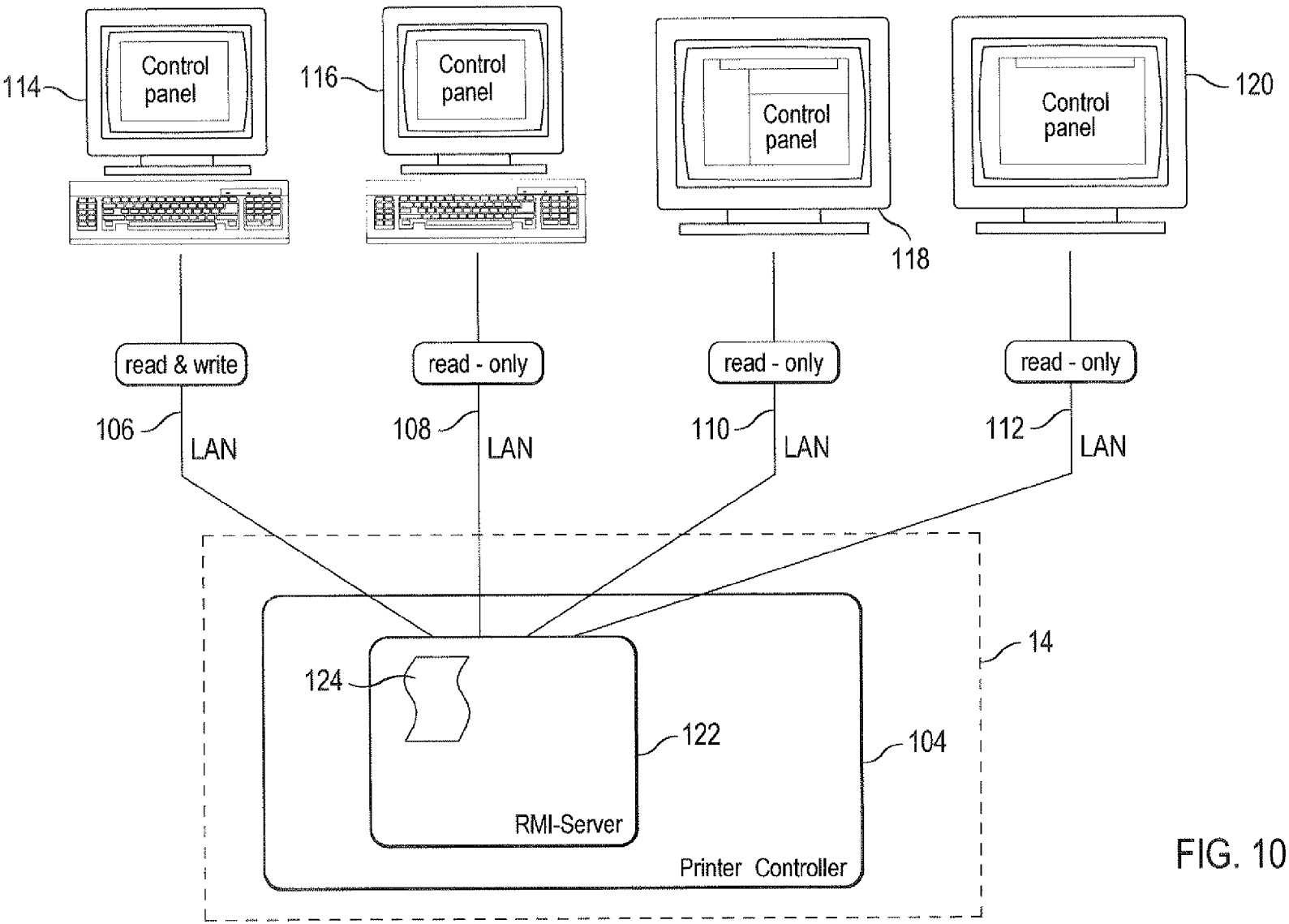
FIG. 10 is a printing system with four operating units.

A printing system 10 in which the printing unit 14 comprises a printer controller 104 is shown in FIG. 10. The operating units 114, 116, 118, 120 are connected with an RMI server 122 (RMI: Remote Method Invocation) via data connections 106 through 112. The RMI server 122 is provided by the printer controller 104. The RMI server 122 provides data for the display of user interfaces on the operating units 114, 116, 118, 120. Furthermore, the RMI server assigns a write access right to the operating unit 114 given a write request via the control panel 114, for example given an input by an operating personnel via an input field on the control panel. Via an operating input on the operating unit 114, this write access right can be returned such that, given a write request via the operating units 116, 118 or 120, it can also be assigned to these. The write access right can only be assigned to one of the operating units 114, 116, 118, 120 at a time.

A higher-prioritized operating unit such as, for example, the operating unit 118, given a user input, the write access right can also be forcibly removed from the operating unit 114 and be assigned to the operating unit 118. The operating unit 114 and the operating unit 116 respectively contain a browser program module with support for the programming language JAVA, whereby RMI objects can be processed. Such a browser program module can, for example, be Microsoft Internet Explorer or Netscape Navigator, whereby these program modules are respectively executed by the data processing unit of the operating units 114, 116. In the operating unit 118, the control panel is integrated into an application, for example in a print server application, as it is shown, for example, in FIGS. 3 through 6. The operating unit 120 comprises a JAVA application that access the data of the RMI server 122 and with this data displays a control panel. The operating units 112 through 120 are what are known as RMI client that access requisition services provided by the RMI server and display control panels with the aid of these services.

For the administration of the write access right, what is known as an access ticket 124, via which a simple administration of a write access right is possible, can also be used. To request a write access right when the write access ticket 124 is already allocated, a message regarding the request of the write access right can also be generated that is then transmitted to the operating unit 114 to which the access ticket 124 is allocated. This message is then output with the aid of the control panel, whereby an operating personnel is informed about the request for the write access and can, if applicable, return or, respectively, release the write access ticket 124.

Although a preferred exemplary embodiment is displayed and specified in detail in the drawings and in the preceding specification, these should be viewed as purely exemplary and not as limiting the invention. It is noted that only the preferred exemplary embodiment is shown and described, and all variations and modifications should be protected that presently and in the future lie within the protective scope of the invention.

The invention claimed is:

1. A printer or copier system with at least one of a pre-processing unit and a post-processing unit, comprising:

a printing unit that generates a print image on a carrier material;

an operating unit that is connected via a data line with the printing unit and via which data are transferable between the printing unit and the operating unit, the operating unit outputting at least one graphical user interface on a display unit for operation of the printing unit;

at least one processing unit connected with at least one of the printing unit and the operating unit for processing of the carrier material and such that data are transferable between the processing unit and at least one of the printing unit and the operating unit; and in the processing unit, data are stored that are transferred to at least one of the printing unit and the operating unit and with which the graphical user interface is activated at least for operation of the processing unit.

2. A printer or copier system according to claim 1 wherein data for the generation of at least the graphical user interface for the operation of the processing unit are transferred from the processing unit to a control panel.

3. A printer or copier system according to claim 1 wherein with the aid of transferred data, the graphical user interface is displayed with data stored in at least one of the printing unit and the operating unit.

4. A printer or copier system according to claim 1 wherein at least one common user interface for the printing unit and the processing unit is generated with the aid of transferred data and with aid of data stored in at least one of the operating unit and the printing unit.

5. A printer or copier system according to claim 1 wherein the system comprises a second printing unit that generates a second print image on the carrier material, in the second printing unit data are stored that are transferred to at least one of the operating unit and to the first printing unit and via which a graphical user interface for operation of the second printing unit is at least activated.

6. A printer or copier system according to claim 1 wherein the printing unit has at least one storage region in which program elements are stored that are loaded and executed by the operating unit to generate the graphical user interface, and wherein the operating unit is a client and the printing unit is a server such that the operating unit and the printing unit operate according to a client-server principle.

7. A printer or copier system according to claim 1 wherein the graphical user interface is output with help of a browser program module, the browser program module is executed by a data processing system of the operating unit, and at least distributed objects are executed by the printing unit.

8. A printer or copier system according to claim 7 wherein the distributed objects comprise remote method invocation objects.

9. A printer or copier system according to claim 1 wherein the operating unit is contained in a print server that supplies a print data stream to at least the printing unit.

10. A printer or copier system according to claim 1 wherein the processing unit comprises a pre-processing unit which at least one of a roller unit, a feed unit, a dampening unit and a cutting unit to generate a predetermined paper format.

11. A printer or copier system according to claim 1 wherein the processing unit comprises a post-processing unit which is at least one of a cutting unit, a binding unit, a stacking unit, a booklet unit, a cooling unit, a dampening unit and a second printing unit.

12. A printer or copier system according to claim 1, wherein program modules to control and to generate the user interface are stored in the printing unit and are executed there, and that the program modules are displayed on a display unit of a data processing system connected via a data line with the printing unit and serving as an operating unit.

13. A printer or copier system according to claim 1 wherein the printing unit and the processing unit are separate structural units.

14. A printer or copier system according to claim 1 wherein the printer or copier system has at least a second operating unit, and the graphical user interface is displayed at a same time on both operating units, inputs in input fields of the graphical user interface being by nature only possible from one of the operating units.

15. A printer or copier system according to claim 14 wherein given a write request via the operating unit, a write access right is assigned to this operating unit.

16. A printer or copier system according to claim 15 wherein the operating unit only receives the write access right when no further operating unit that has already been granted a write access right is connected with the printing unit.

17. A printer or copier system according to claim 16 wherein given a request for a write access right by the operating unit, a message via which an operating personnel of a further operating unit is asked to return the write access right is transmitted to the further operating unit.

18. A printer or copier system according to claim 17 wherein the operating unit has a higher user right relative to a further operating unit, and the write access right is withdrawn from the further operating unit given a write access right request by the operating unit.

19. A printer or copier system according to claim 1 wherein the printing unit authenticates a respective control panel, and data to generate the graphical user interface are only transferable to an authenticated operating unit.

20. A printer or copier system according to claim 1 wherein the system comprises an electrophotographic printer or copier system.

21. A method to operate a printer or copier system with at least one of a pre-processing unit and a post-processing unit, comprising the steps of:

generating a print image on a carrier material with aid of a printing unit;

operating the printing unit with an operating unit with aid of a graphical user interface output on a display unit, the operating unit being connected with the printing unit with aid of a data line via which data are transferred between the printing unit and the operating unit;

processing the carrier material with the at least one processing unit, the processing unit being connected with at least one of the operating unit and the printing unit for transfer of data between the processing unit and the operating unit; and with the processing unit transferring data to the operating unit via which said graphical user interface is at least activated for operation of the at least one processing unit.

22. A method according to claim 21 wherein the method is used for operation of an electrophotographic printer or copier system.

* * * * *